United States Patent [19]

Bicskei

[11] 4,229,911

[45] * Oct. 28, 1980

[54] PRECISION BLOCKING OF SEMI-FINISHED LENS BLANKS

[76] Inventor: Bela J. Bicskei, 7 Hemenway Rd., Framingham, Mass. 01701

[ * ] Notice: The portion of the term of this patent subsequent to Feb. 6, 1996, has been disclaimed.

[21] Appl. No.: 893,078

[22] Filed: Apr. 3, 1978

[51] Int. Cl.[3] ..... B24B 1/00

[52] U.S. Cl. ..... 51/284 E; 51/277; 33/174 A

[58] Field of Search ..... 51/277, 284; 33/174 A

[56] References Cited

U.S. PATENT DOCUMENTS

| | | | |
|---|---|---|---|
| 2,917,971 | 12/1959 | Goddu | 33/174 A X |
| 3,049,766 | 8/1962 | Buckminster | 51/277 |
| 3,451,177 | 6/1969 | Buckminster | 51/277 |
| 3,507,076 | 4/1970 | Rudd | 51/277 |
| 3,861,089 | 1/1975 | England | 51/284 |
| 4,077,722 | 3/1978 | Bicskie | 33/174 A |
| 4,138,085 | 2/1979 | Bicskie | 51/277 |

*Primary Examiner*—Gary L. Smith

*Attorney, Agent, or Firm*—George E. Kersey

[57] ABSTRACT

Method and apparatus for the precision blocking of semi-finished lens blanks by the adjustment of each such blank until it occupies a prescribed position where an alloy hub or "block" is removably affixed to the blank so that it can be properly gripped for finishing.

6 Claims, 20 Drawing Figures

PRECISION BLOCKING OF SEMI-FINISHED LENS BLANKS

BACKGROUND OF THE INVENTION

This invention relates to the blocking of semi-finished lens blanks, and, more particularly, to the precision attachment of blocks to the surfaced sides of semi-finished lens blanks with multi-focal segments to permit prescribed surfacing of the opposite sides of the blanks.

Semi-finished lens blanks require further processing before they can be used. Such blanks often incorporate one or more special elements, such as bifocal segments. One side of the lens containing, for example, a bifocal segment, is ground i.e., surfaced, in a prescribed fashion. The opposite side is in a roughened form just as it is received from the mold.

Before a semi-finished lens blank with a bifocal segment can be used, the rough side must be surfaced in accordance with a prescription provided by an oculist or optometrist. This requires the placement of a temporary hub or block on the finished side of the blank so that it can be held by an appropriate tool for finishing the other side, as well as the edge of the blank.

In the usual procedure the desired optical parameters are manually located and marked on the blank. A representative device for marking a lens blank is described in U.S. Pat. No. 2,917,971 which issued to L. W. Goddu, et al. on Dec. 22, 1959. Once the lens blank has been appropriately marked, it is then transferred to a special instrument or "blocker" where the hub or block is temporarily affixed. This procedure is cumbersom and inaccurate. It requries operators with considerable skill, yet it typically produces tolerances which do not satisfy recognized standards. The consequence, for example, of improper location of the optical center of a multifocal lens can be eye strain, headaches and other visual difficulties.

Accordingly, it is an object of the invention to increase the precision with which lens blanks can be processed, particularly lens blanks with special elements. A related object is to obtain increased precision in the processing of multifocal lens blanks. Another related object is to achieve the precise blocking of lens blanks, particularly bifocal and multifocal lens blanks.

Another object is to reduce the number of rejects encountered in the processing and blocking of lenses, especially multifocal lenses. A companion object is to raise the level of accuracy of acceptable lens blanks.

A further object is to achieve the precision processing of lens blanks with only semi-skilled operators. A related object is to facilitate the finishing of semi-finished lens blanks, particularly those containing multifocal segments.

SUMMARY OF THE INVENTION

In accomplishing the foregoing and related objects, the invention provides for the precision adjustment of lens blanks relative to a viewing instrument, followed by the precision placement of a block on the lens blank, without disturbing its adjustment on the viewing instrument.

The viewer provides two degrees of translational motion. This permits accurate adjustment of the lens blank until prescribed optical conditions have been satisfied. Thus a bifocal lens blank can be centered and then de-centered on a viewing instrument by a prescribed amount in accordance with a prescription of a particular user.

The accuracy of each optical condition established using the instrument is maintained while the block is being attached. This eliminates the need for auxiliary scales and the marking of the blanks. The blocking may take place by forming a block on the lens while in position on the viewing instrument or by using a pre-formed block in conjunction with an adhesive member. The block holds the blank for proper finishing of the lens blank.

As a result the required skill of the operator is significantly reduced and the quality of the final, finished product is considerably increased.

DESCRIPTION OF THE DRAWINGS

Other aspects of the invention will become apparent from the detailed description which follows taken in conjunction with the drawings in which.

DETAILED DESCRIPTION

Figure 1A:
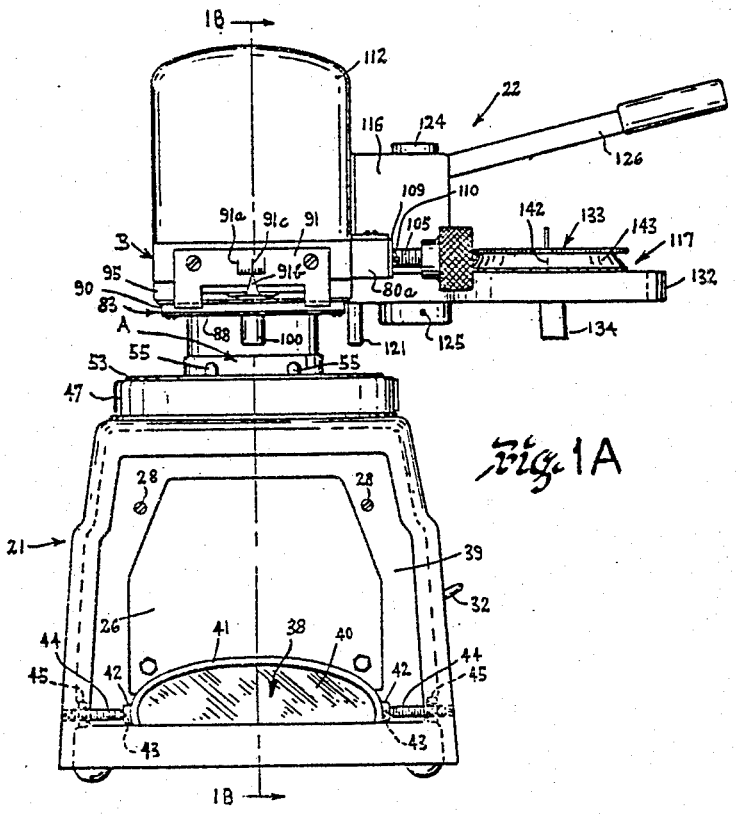
FIG. 1A is a front elevational view of one form of device embodying the invention.
Figure 1B:
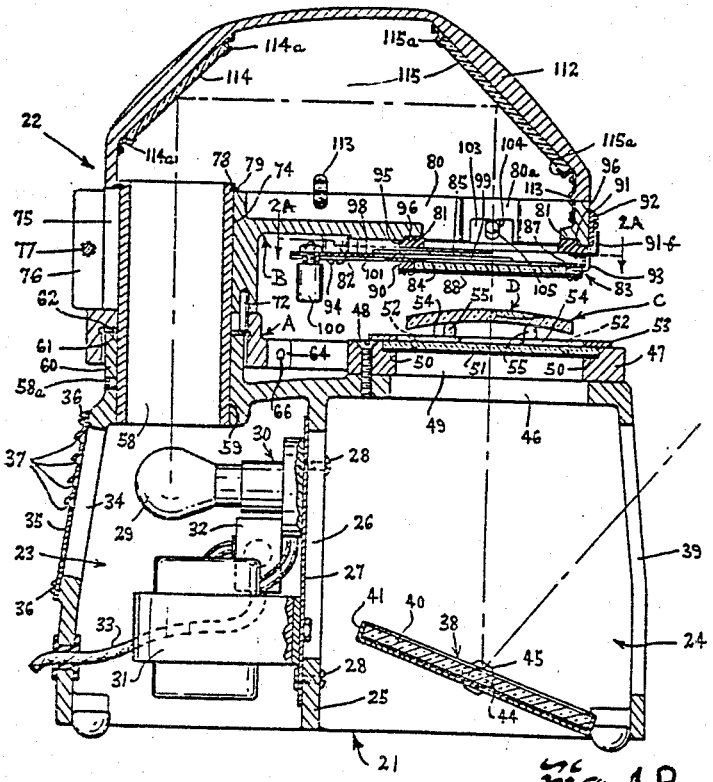
FIG. 1B is a side sectional view of FIG. 1A taken substantially on line 1A—1A.
Figure 1C:
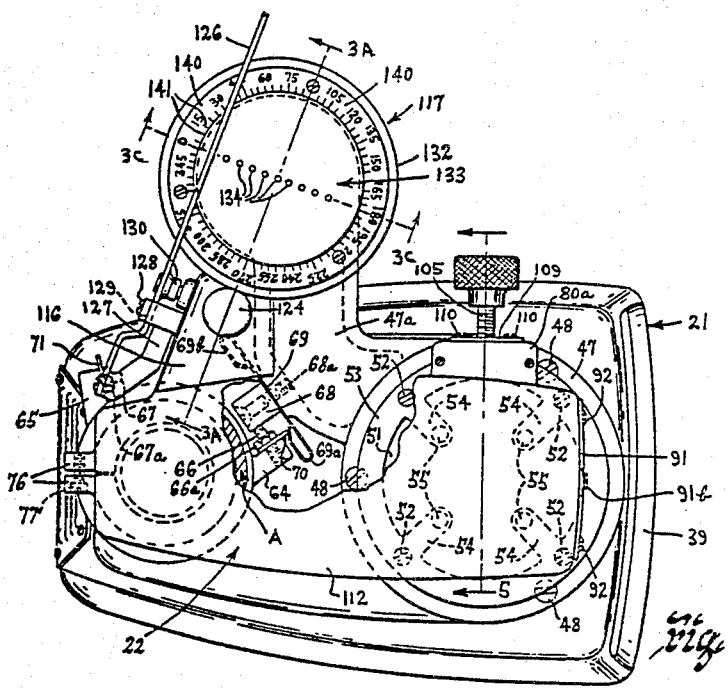
FIG. 1C is a top plan view of the device of FIG. 1A partially broken away.

With reference to the drawings, one form of device embodying the invention, as shown in FIGS. 1A through 1C is formed by a base 21 for supporting and viewing a lens blank and a head 22 rotatably mounted upon base 21 for aligning the lens blank when positioned upon the base 21.

The base 21 is of any suitable material and is constructed with a hollow interior which is open at the bottom. The hollow interior is further divided into two chambers 23 and 24 by a wall 25 which is an integral part of the base 21 and has an opening 26.

A plate 27 of suitable material is positioned over the opening 26 and is secured to it by means of screws 28. A point source of light or lamp 29 is supported upon one side of the plate 27 by a socket 30 extending into the cavity 23 and adapted to project a beam of light upwardly through an opening in the upper portion of the base 21 as described below. Beneath the light source 29 is a transformer 31 electrically connected to the lamp 29 to control the amount of current passing to the lamp. The transformer is, in turn, electrically connected through an on-and-off switch 32 mounted on one side of the base 21, to a source of current carried by an electrical conductor 33.

An opening 34 is provided in the rear wall of the chamber 23 with a cover plate 35 secured to the base 21 by screws 36. The cover plate 35 is further provided with louvered openings 37 to allow the evacuation of heated air within the cavity 23 caused by the lamp 29.

The forward chamber 24 within the base 21 has a pivotally mounted mirror 38 which is used to view the combined images of a bifocal lens segment and targets for aligning of the segment image. The mirror 38 is preferably formed with a concave reflecting surface for enlarging the reflected image.

In order to view images of the lens segment and targets, an opening 39 in the front of the base 21 communicates with the chamber 24 as shown in FIGS. 1A and 1B.

The mirror 38 include as a circular glass plate 40 silvered on one of its surfaces for reflection and mounted within a frame 41 having dimetrically opposed lugs 42. The lugs 42 are further adapted to receive conically shaped ends 43 of supporting screws 44 which are threadedly attached to the opposed side walls of the base 21 to allow the mirror 38 to be rotated about the axis of the screws 44. Rotation of the screws 44 in the other direction relieves the tension between lugs 42 and the ends 43 of the screws 44 thereby allowing the mirror 38 to be freely rotated about the axis of the screws 44. When the desired amount of tension upon the mirror lugs 42 is obtained, lock nuts 45 are tightened against the sidewalls of the base 21 to prevent further accidental rotation of the screws 44.

A circular opening 46 is provided in the top of the base 21 and is positioned over and in vertical alignment with the center of the mirror 38. A circular supporting member 47 with an L-shaped extenion 47*a* is secured directly over the opening 46 by screws 48 which threadedly engage the top of the base 21. The supporting member 47 is further provided with a circular opening 49 aligned with the opening 46 and having a circular shoulder portion 50 adapted to receive a ground glass viewing screen 51 which, in turn, is attached by screws 52 to a circular plate 53 overlying the shouldered opening 50 and intimately contacting the top of the plate 47. The circular plate 53 is provided with inwardly extending fingers 54 with upstanding pins 55 having rounded or spherically formed tops adapted to be engaged by a lens blank when the lens blank is positioned thereupon for alignment.

The plate 53, pins 55 and ground glass assembly 51 is constructed to be rotatably mounted upon the supporting member 47. It will be noted in FIG. 1B that sufficient clearance between the bottom of ground glass 51 and the shouldered portion 50 is provided to allow rotation without affecting the contact between plate 53 and supporting member 47.

The head 22 of the device is composed of three sections similar to the base 21 and having parts assembled to function as a single unit. The head 22 is rotatably mounted upon the base 21 by an elongated tubular supporting member 58 which is intimately fitted within a vertically extending bore 59 in an upstanding portion 60 of the base casting 21 and secured by a set of screws 58*a*.

The top of the upstanding portion 60 of the base casting 21 is accurately machined to a flat surface 61, over which is positioned a washer 62.

Rotatably mounted upon the tubular supporting member 58 and positioned over the washer 62 is a locating member A, with two spaced, outwardly extending lugs 64 and 65 (FIGS. 1B and 1C). The lugs 64 and 65 are further provided with adjustable stop pins 66 and 67 which threadedly engage the lugs 64 and 65 respectively and are locked in their desired extended position by locking nuts 66*a* and 67*a*, as shown in FIG. 1C.

A stop 68 is secured to one side of the L-shaped extension 47*a* of the supporting member 47 by a screw 68*a* that extends outwardly of said L-shaped extension a distance sufficient to be contacted by the stop pins 66 and 67 when rotation of the head 22 is effected.

It can be seen from FIG. 1C that rotation of the head 22 in a clockwise direction will cause stop pin 67 to be moved into contact with one side of the stop 68 thereby preventing any further clockwise rotation of the head 22. Counterclockwise rotation of the upper portion 22 will cause stop pin 66 to be moved into contact with the other side of stop 68 and similarly prevent further counterclockwise movement.

In order to yieldably retain one or the other of the stop pins 66 and 67, positioned against the stop 68, for purposes of aligning and blocking a bifocal lens blank, there is provided a spring clip 69 which is attached to the L-shaped extension 47*a* by stop 68 and a screw 68*a*. One end 69*a* of spring clip 69 is positioned to be engaged by a metal plate 70 when the stop pin 66 is about to approach the stop 68. Plate 70 is secured to lug 64 by lock nut 66*a*. As counterclockwise rotation of stop pin 66 continues the end 69*a* of the spring clip is forced in a direction toward the L-shaped extension 47*a* until the stop pin 66 contacts stop 68, whereupon the end 69*a* of the spring clip again assumes its normal position and latches over plate 70, yieldably retaining the stop pin 66 against the stop 68.

By forced rotation in a clockwise direction the end 69*a* of the spring clip is caused to release the plate 70, stop pin 66 and lug 64 assembly. Continued clockwise rotation causes the engagement of plate 71, which is secured to the lug 65 by the opposed end 69*b* of the spring clip. Plate 71 is identical to plate 70.

The end 69*b* of the spring clip and the plate 71 functions in a manner identical to plate 70 and the end 69*a* of spring clip 69.

Positioned above the casting A, as shown in FIG. 1B, and secured by a press-fitted pin 72, is a further casting B which is rotatably mounted upon the upper end of the tubular supporting member 58 by a vertically extending bore 74 within the casting B. A slotted opening 75 is provided in the portion of the casting B which surrounds the tubular support 58, slotted opening 75 being adapted to communicate with the bore 74 and extend vertically throughout the length of the bore 74. The casting B is further provided with integrally formed outwardly and rearwardly extending lugs 76 adjacent the opposed sides of the slot 75. The lugs 76 are connected by a stud 77 which threadedly engages one of the lugs 76 and is adapted to freely rotate within the other of lugs 76. Rotation of the stud 77 in one direction causes the lugs 76 to be drawn together increasing the frictional engagement of the bore 74 and the tubular supporting member 58 while rotation of the stud 77 in the other direction allows the casting B to be freely rotated about the tubular member 58.

To retain the casting B and casting A in the proper vertical position upon the tubular support 58, an annular slot 78 (FIG. 1B) is provided in the top of the tubular support 58 and a split retaining washer 79 is positioned in the slot overlying the top of casting B.

Casting B further is provided with a forwardly extending portion 80, the underside of which has a pair of guide ways 81 and two downwardly extending bosses 82 which are adapted to support a target assembly 83 used in aligning a lens blank prior to the blocking of the lens blank. The forwardly extending portion 80 is further provided with a protruding portion **80*a*, (FIGS. 1A through 1C and 2B) which is adapted to receive and further support the target assembly 83**.

Figure 2A:
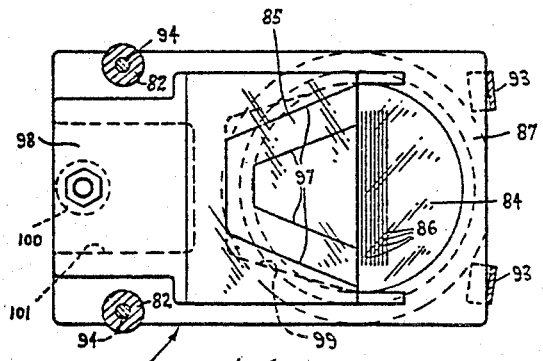
FIG. 2A is a sectional view taken on line 2A—2A of FIG. 1B showing target-supporting mechanism.
Figure 2B:
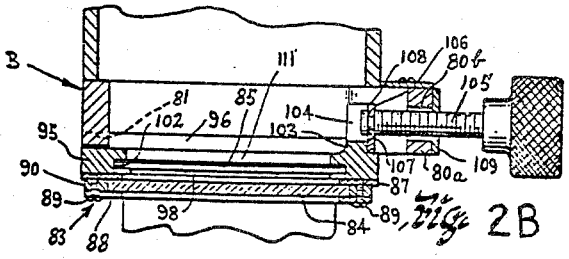
FIG. 2B is a fragmentary sectional view taken on line 2B—2B of FIG. 1C.

Referring more particularly to FIGS. 1B, 2A and 2B, the target assembly 83 is broadly formed by a stationary target 84 and a movable target 85. The stationary target 84 has a series of transversely extending clear cut lines 86 painted, etched or otherwise provided upon a circular sheet of suitable transparent material such as glass or plastic and are so spaced as to provide a one millimeter distance between the image of each of said lines 86 when said image is projected upon the surface of a lens positioned therebelow as shown in FIG. 1B.

It will be noted that the spacing of the lines 86 need not be restricted to the one millimeter, although the millimeter scale has become common practice in the optical trade.

Stationary target 84, as shown best in FIG. 2B, is mounted on the underside of a sheet metal supporting plate 87 by a ringlike member 88 secured to plate 87 by screws 89 which extend through a spacer member 90 surrounding the periphery of the target 84, and threadedly engage the plate 87. The ringlike member 88 and the spacer 90 are positioned to properly align the target 84 with a circular opening which is provided in the supporting plate 87.

Supporting plate 87 is fixedly secured to the forwardly extending portion 80 of casting B by means of a clamp or the like 91, FIGS. 1B and 1C, which is mounted upon the forward end of said casting B by means of screws 92. The clamp 91 is further provided with two downwardly extending fingers 93 having their ends bent inwardly and positioned under the forward end of the plate 87, as shown best in FIGS. 1B and 2A.

The opposed end of the plate 87 is secured to the casting B by the screws 94 which extend through plate 87 and threadedly engage the two downwardly extending bosses 82.

Slidably mounted upon the upper surface of the plate 87 is a slide 95 adapted to carry the movable target 85. The slide 95 is constructed with a pair of tracks 96 which are adapted to slidably fit within the guideways 81.

The movable target 85 includes a transparent sheet of glass, plastic or the like upon which is painted, etched, or otherwise provided forwardly diverging or V-shaped guidelines 97 which are used to center the segment portion of a bifocal lens blank prior to the blocking of the lens blank.

The target 85 is secured to the upper side of a sheet metal carrier 98, FIGS. 1B, 2A and 2B, having a forwardly extending opening 99 to allow the passage of light through the major portion of the target 85. A handle 100, used to manually slide the carrier 98 and target 85 assembly longitudinally, is secured to the rear portion of the carrier 98 and extends through an enlarged opening 101. FIGS. 1B and 2A, provided in the plate 87. The opening 101 is of a shape and size sufficient to allow the desired forward and backward movement of the carrier 98, as well as necessary sidewise movement.

The longitudinal movement of the target 85, by the handle 100 is to allow the operator to position the V-shaped guide lines 97 into bisecting relation with the outer boundaries of the segment, when the segment is moved into decentered position, thus being able to compensate for different size segments.

To restrict and regulate the sidewise movement of the carrier 98 and target 85 assembly, a forwardly extending channel 102, FIG. 2B, is provided on the underside of the slide 95 into which the carrier 98, target 85 assembly is positioned. By manipulation of the handle 100, the target 85 may be moved forwardly or rearwardly along the upper surface of the plate 87 while being confined within the channel 102.

In order to move the target 85 crosswise of the stationary target 84, the slide 95 is further provided with an upstanding ear 103, FIGS. 1B and 2B, integrally formed at one end thereof and having a U-shaped slot 104 adapted to receive one end of an adjusting screw 105. The end of screw 105 is provided with an annular groove 106 which is fitted into a narrower U-shaped slot 107, provided in a plate 108 suitably fastened to the ear 103.

Adjusting screw 105 extends outwardly of ear 103 through an opening **80*b* in the protruding portion 30*a* of the casting B and threadedly engages a plate 109 which is secured to said protruding portion 80*a* by means of screws or the like 110 FIGS. 1A, 1C and 2B**.

Rotation of the adjusting screw in one direction will cause the screw to be advanced inwardly of threaded plate 109 and force the slide 95 and movable target 85 which is confined within channel 102 of slide 95, to be moved in a similar direction. If the adjusting screw 105 is rotated in the opposite direction, however, screw 105 will move in the reverse direction thereby causing the slide 95 and target 85 assembly to follow and be moved in the opposite direction across the stationary target 84.

In order to record the sidewise movement of the slide 95 suitable scaled markings **91*a* are engraved, printed, or otherwise provided upon the clamp 91, FIG. 1A. A pointer 91*b*, attached to the side 95 and movable therewith extends outwardly and upwardly from the slide 95 to a position adjacent the markings 91*a* for recording the distance that the slide is moved when the adjusting screw 105** is rotated.

It is to be noted that the guide ways 81 and tracks 96 are accurately machined and interfitted preventing any lateral movement of the slide 95, while being adjusted, also that the channel 102, formed in the slide 95 is further accurately machined so as to form a path of travel for the carrier 98 and target 85 assembly which is exactly 90 degrees of the movement of the slide 95 and that the underside of both the slide 95 and carrier 98 contact and slide along the upper surface of plate 87.

It is to be further noted that the stationary target 84 is aligned with and positioned over the ground glass viewing screen 51 and that the target 85 is further adjustably mounted over the stationary target 84 to allow the passage of light through a suitable opening 111 provided in the slide 95, movable target 85, stationary target 84, a bifocal lens blank to be aligned and blocked and ground glass 51 for purposes of aligning said bifocal lens blank prior to blocking.

A cover 112 is fitted over casting B and secured by spring clips 113 fastened to the casting B and adapted to snap over suitable protrusions formed on the inner surface of the cover 112 as shown in FIG. 1B. Two mirrors, preferably of the front surface reflective type 114 and 115 are secured to the upper inside surface of the cover 112 by suitable brackets **114*a* and 115*a*, respectively. Mirror 114, located at the rear inner surface of the cover 112, is positioned to be directly over and centrally aligned with the opening provided in the tubular member 58 and disposed at an angle of substantially 45 degrees to the vertically extending axis of the tubular member 58, so that the light emitted upwardly by the light source 29 through the tubular member 58 will strike the mirror 114 and thence be directed forwardly to the second mirror 115 positioned on the forward inner wall of the cover 112. The mirror 115 will then direct the light downwardly through the movable target 85, stationary target 84, a bifocal lens blank to be aligned and screen 51 to viewing mirror 38**.

It is to be noted that the light source 29 is substantially a point source which emits diverging rays. Since it is desirable to have light rays nearly parallel to each other, at the points where they pass through the targets 85 and 84 and lens blank C, FIG. 1B, the mirrors 114 and 115 are positioned to compactly form a relatively long path of light between the source 29 and the ground glass screen 51, causing the rays of light to be substantially parallel at targets 84 and 85 and lens blank C.

Since the light rays are not exactly parallel when passing through the targets 84 and 85 to the surface of the lens blank C, it is necessary to compensate for the slight diverging effect which will occur and cause the spacings between the images of the target lines projected on the lens blank to be slightly enlarged.In order that the images of the target lines 86 of target 84 be spaced on the lens blank C, a desired increment of measurement, such as one millimeter, the actual target lines on the target are spaced slightly closer together by an amount sufficient to compensate for the divergence of the light rays so that when projected on the lens blank, they will be spaced the desired distance apart. To compensate for the divergence of the light rays in relation to the lateral positioning of the image of the V on the target 85, the scale markings **91*a* on the clamp 91, which record the lateral movement are spaced closer together by an amount sufficient to compensate for the divergence of the light rays so that the movement of the target, as indicated on the scale, will move the image of the V projected on the lens blank C the desired distance. The distance between the targets and the lens blank and the angle of the light rays are the controlling factors in determining the spacing of the lines 86 of the target 84 and the spacing between the scale markings 91*a***.

The difference in curvatures and index of refraction of the segment portion D with respect to the major portion of the lens blank C, because the light is substantially parallel, creates a discrete optical boundary which is shadowed by the point source illumination system and thus causes an image of the outline of the segment portion D to be simultaneously projected, with the images of the targets, through the lens blank C and onto the screen 51.

Since the distance between the lens blank C and the ground glass screen 51 is relatively short as compared to the distance from the target to the light source 29 and the angle of divergence of the light rays is very slight at the targets and lens blank C, the combined images of the targets and the outline of the segment portion D as viewed upon the screen 51, by means of mirror 38, are seen as distinct clean-cut lines which are readily visible to the operator of the device.

Casting B also has integrally formed thereon an outwardly extending portion 116 adapted to support one end of a lens blocking device 117 as shown in FIGS. 1A, 1C, 3A and 3B. The portion 116 has a vertically extending bore 118 (FIG. 3A) which in turn is press fitted with a bushing 119 adapted to slidably receive a tubular guide member 120 which is press fitted at one end of the blocking device 117.

To prevent rotation of the blocking device about the axis of the tubular guide 120 and to further accurately locate the blocker device 117 upon the extending portion 116, a locating pin 121 is press fitted in the portion 116 and extends downwardly through a vertical bore 122 in the blocking device 117, the bore 122 and pin 121 being of controlled dimensions so as to provide an intimate sliding fit.

In order to cause the blocking device 117 to be urged upwardly and against the bottom of the extending portion 116 when not in use position, a spring 123 is provided within the tubular member 120 having one end attached to a shouldered retainer 124 and the opposed end secured to the blocking device 117 by a pin 125 extending through the tubular guide 120.

Operation of the blocking device 117 is accomplished by a handle 126 which is pivotally attached to one end of a bracket 127 secured to the outwardly extending portion 116 by screws 128. Bracket 127 is further provided with a guideway 129 (FIGS. 1C and 3B) adapted to receive the handle 126 and prevent sidewise movement while allowing the handle to be moved up and down within the guideway 129.

A connecting link 130 is pivotally connected to the handle 126 at a pont outwardly of the bracket 128 and adjacent the guideway 129 and extends downwardly to a second pivotal connection 131 on the device 117.

Downward movement of the handle 126 will then cause the blocking device 117 to be correspondingly moved in the same direction along the locating pin 121 and bushing 119 in which the guide member 120 is slidably mounted, thereby extending the spring 123.

Upon release of the handle 126 the blocking device will again return to its initial position against the bottom surface of the member 116 due to the tension in the spring 123.

Figure 3A:
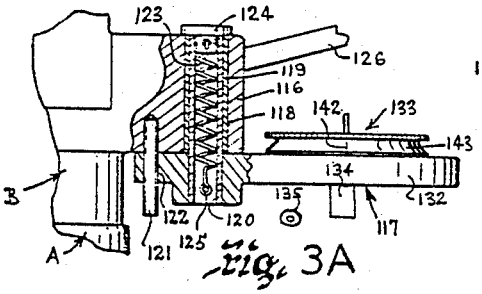
FIG. 3A is a fragmentary side view of one form of lens blocking mechanism shown partially in section and looking in the direction indicated by line 3A—3A of FIG. 1C.
Figure 3B:
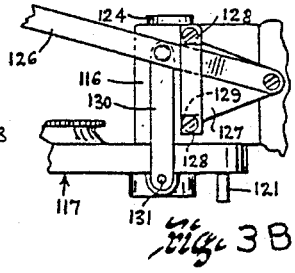
FIG. 3B is a fragmentary view of the other side of the blocking mechanism shown in FIG. 3A.
Figure 3C:
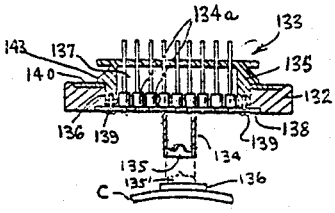
FIG. 3C is a sectional view taken on line 3C—3C of FIG. 1C.

The opposed end of the blocking device 117 is provided with a circular supporting portion 132 which is adapted to carry a rotatably adjustable holder 133 having a carrier 134 for a preformed block 135. The circular recess that is proportioned to hold the preformed block 135, as shown in FIG. 3C, when the carrier 134 is positioned over the lens blank C in FIG. 3C, and a double faced adhesive strip 136 is placed on the blank C, one surface of the strip 136 adheres to the blank C and the other surface the block 135, consequently when the carrier 134 is depressed the block 135 comes into engagement with the exposed adhesive surface and becomes adhered to the blank C. Accordingly, when the carrier 134 is released, the block 135 is withdrawn from its nest in the carrier 134, and the desired blocking of the blank C has been achieved without the need of marking the blank C or removing it from the instrument. It will be understood that the carrier 134 may be adapted to form an alloy block (not shown) on the lens blank C in place of the preformed block 135.

The operation of the device is summarized as follows:

When viewed from the front as in FIG. 1A the head 22 is rotated to the right until the stop pin 66 contacts the stop 68 to accurately align the target assembly.

A lens blank C, which is usually of the fused bifocal type with an optically finished convex surface is positioned upon the supporting pins 55 with the finished surface up as shown in FIG. 1B.

The light 29 is then turned on by operation of switch 32 causing an image of the targets 84 and 85 and a further image of the outline of the reading segment portion D of the lens to be simultaneously projected through the lens blank C and onto the ground glass screen 51. By proper adjustment of the mirror 38, the operator may view the images which would appear substantially as diagrammatically illustrated in FIGS. 4A, 4B and 4C.

In order to decenter the reading segment of the lens blank a prescribed distance either to the right or left of the optical center, the entire target assembly 83 is adjusted by adjusting screw 105, which causes the pointer **91*b* to move along the scaled marking 91*a*. Markings to the right of center line 91*c* are used for decentering the segment portion of the lens blank to the right whereas the markings to the left of center line 91*c* are used to decentration to the left. This adjustment positions the V-shaped lines 97 to the right or left of the normal central position thereof as indicated by the zero setting 91*c* on the scale 91*a***.

After having set the device for the proper decentration, the operator next moves the lens blank C forwardly or rearwardly as necessary over the pins 55 to a point where the top of the outline of the segment portion image positioned over the image of a selected one of the target lines 86 as viewed in mirror 38, which is selected according to the position desired of the top line of the segment below the optical center of the distance field of the finished lens. By doing so, the segment portion is positioned a prescribed distance below the optical center of the lens since the optical center due to the construction of the device is normally aligned with the uppermost of lines 86.

By operation of the handle 100 and simultaneous sidewise movement of the lens blank C over pins 55, the operator then positions the image of the segment portion D between a pair of the V-shaped target markings 97 with the opposite side edges of the segment appearing to touch the respective branches of the V while still maintaining the previous alignment of the top of the segment portion D with the selected target line 86 and, having thus completed the above described alignment procedure, the lens is then ready for marking.

It is to be noted that the V-shaped target markings 97 to be used in centering the segment portion D are selected in accordance with the size of segment encountered. If the segment portion D is large, as shown by dotted lines in FIG. 4A, the larger V-shaped marking is used. It is also to be noted that the alignment markings 97 need not be restricted to the V-shape but that suitable vertical markings **97*a* such as shown in FIG. 4C** and corresponding to different given sizes of segments may also be used.

The lens blank C is allowed to remain in its aligned position upon the pins 55 while the retaining member 135 is rotated in its holder 132 an amount sufficient to position the mark 142 thereupon which is aligned with a selected degree marking 141 on the stationary plate 143. By doing so, the pins 134 are correctly positioned for blocking the blank C with the proper axis orientation for the block 135.

The head 22 of the device is then manually swung to the left by a sidewise movement of the handle 126, until the locating pin 67 contacts the stop 68.

The target supporting mechanism at this point has been moved away from the lens blank C and the blocking device 117 is precisely aligned over the lens blank. The handle 126 is depressed until all the block 135 has contacted the upper surface of lens blank C and the block 135 is adhered to the lens blank C as desired.

Figure 4A:
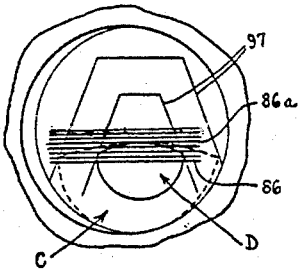
FIG. 4A is a view of the image formed by the aligning target and the outline of a bifocal lens blank reading segment as would be viewed by an operator of the device of FIGS. 1A through 1C.
Figure 4B:
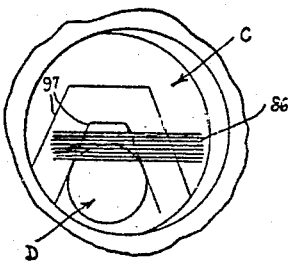
FIG. 4B is a view generally similar to FIG. 4A showing the image of an alternately shaped lens reading segment.
Figure 4C:
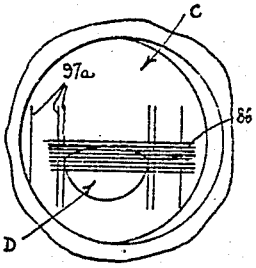
FIG. 4C is a view generally similar to FIGS. 4A and 4B showing a different type of target being used for aligning a lens blank reading segment.

Referring more particularly to FIG. 4A, an example of a typical alignment and blocking procedure would be as follows:

If the requirements, according to a prescription were that the reading segment portion D of the lens blank be positioned three millimeters below and decentered a distance of three millimeters to the right of the optical center of the major portion of the lens blank, the head 22 would be positioned as shown in FIGS. 1A, 1B and 1C and the pointer **91*b* would be moved to the third indicating mark at the right of the center mark 91*c*. The lens blank C would then be moved forwardly upon pins 55 until the image of the top of the segment portion D appears over the third line 86*a* from the top. The lens segment would then be centered between the V-shaped target lines 97** as described above.

If, according to the prescribed formula, the cylinder axis line were to be at zero or 180 degrees, which would be along the line 90 degrees to the vertical axis of the segment portion D of the lens blank as shown in FIG. 4A, the indicating line 142 on the marking device would be set at zero or 180 degrees following which the lens blank would be blocked according to the procedure described above.

Other ways of performing the above-described operation are shown in FIGS. 5A through 9 wherein FIGS. 5A, 5B, 5C and 6A show an alternative device 144 attached by a supporting bracket 145 to the head 146 of a device generally similar to the device described above.

Figure 5A:
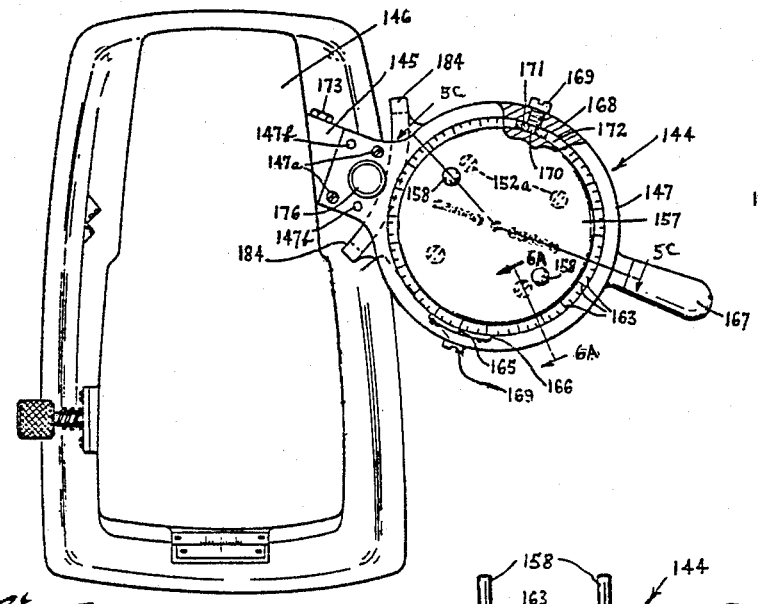
FIG. 5A is a top plan view of another form of the invention.

A supporting ring 147 is attached to and aligned with the bracket 145 by means of screws **147*a* and pins 147*b*, FIG. 5A. Rotatably mounted within the supporting ring 147 is a retaining member 148 having a cavity 149 to receive a carrier 150 which is mounted within the cavity 149 by circular plates 151 and 152 secured to the under and upper sides respectively of the retaining member 148 by means of screws or the like 152*a***, FIG.

6A. The plates 151 and 152 are further provided with a series of aligned diametrically extending openings 153 and 154, FIG. 5C which are adapted to slidingly receive the lower and upper ends respectively of the carrier 150.

The carrier 150 is provided with enlarged shouldered portions 155 which contact the upper surface of plate 151 to restrict downward movement when not in use and the carrier 150 further provided with springs 156 positioned between the shouldered portions 155 and the upper plate 152 to yieldably retain the downwardly against the inner surface of plate 151.

Figure 5C:
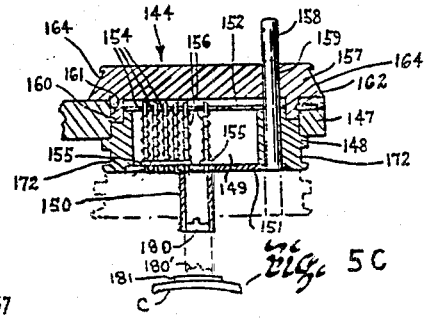
FIG. 5C is a sectional view taken on line 5C—5C of FIG. 5A.

Retaining member 148 is slidably mounted upon a rotatable upper carried 157 by means of guide pins 158 which are press fitted or otherwise secured to said retaining member 148 and extend upwardly through openings 159, FIG. 5C, provided in the housing 157.

Figure 6A:
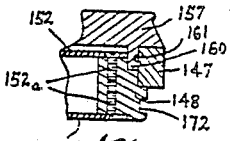
FIG. 6A is a sectional view taken on line 6A—6A of FIG. 5A.

Housing 157 has a downwardly extending portion 160, FIGS. 5C and 6A, which is provided with an annular groove or the like 161 adapted to receive a spring loaded pin 162 which extends through the supporting ring 147 and frictionally engages the groove 161 to prevent the housing 157 from being accidentally lifted from the supporting ring 147 as well as to provide a tension upon the housing 157 to prevent accidental rotation.

Rotation of the housing 157 will cause the retaining member 148 to rotate due to the connecting guide pins 158 and thus angularly position the carrier 150. In order to indicate the angular position of the carrier 150, degree markings 163 are provided upon the inwardly tapering portion 164 of the housing 157 which are adapted to be aligned with an indicating mark 165 provided upon the upper edge of a plate 166 which is secured to the support 147 as shown in FIG. 5A.

Operation of the housing device 144 is accomplished by an outwardly extending handle 167 integrally formed upon a pivotally mounted yoke 168 having two diametrically opposed pivot pins 169. Each of pivot pins 169 is further provided with reduced shouldered portions 170 which pivotally engage guide blocks 171 adapted to slidingly fit within an annular channel 172 provided upon the downwardly extending portion of the retaining member 148.

Figure 5B:
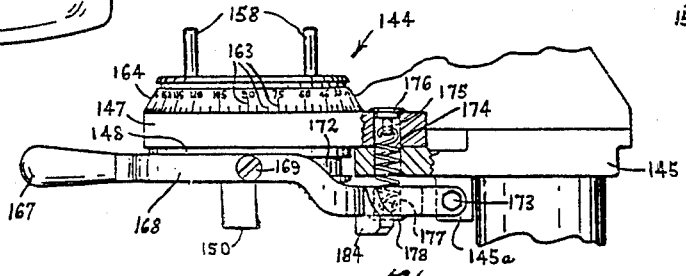
FIG. 5B is a fragmentary side view of another form of a marking device taken in conjunction with FIG. 5A.

The inwardly extending portion of the yoke 168 is pivotally secured to a downwardly extending lug 145*a*, FIG. 5B, formed upon the supporting bracket 145 by studs 173. In order to yieldably retain the yoke 168 and retaining member 148 assembly upwardly and in contact with the support 147 when not in use, the upper portion of a spring 174 is positioned within a vertically extending bore 175 provided in the supporting ring 147 and bracket 145 and is attached to a shouldered retaining member 176 whereas the lower end of the spring 174 is positioned within a similar bore 177 provided in the yoke 168 and is attached to a second shouldered retaining member 178.

Downward movement of the handle 167 would then cause the yoke 168 to pivot about studs 173 and extend the spring 174 at which time the retaining member 148 would be carried downwardly with the yoke 168 due to its connected relation as described above, and upon release of handle 167 the tension provided by spring 174 would then cause said yoke 168 and retaining member 148 assembly to again return to its initial position.

It will be noted in FIG. 5C that the downward movement of the retaining member 148, as shown by the dotted lines, causes guide pins 158 carried by said retaining member 148 to slide within the bores 159 thereby causing the housing 150 to be moved along a vertical axis while yoke 168 is pivoted about studs 173.

The head 146 is rotated until the blocking device 148 is accurately positioned over a lens blank to be marked whereupon the handle is depressed and causes the carrier 150 to contact and deposit the block 180 upon the surface of the lens blank in a manner generally similar to that described previously for the blocking device 117.

Figure 7A:
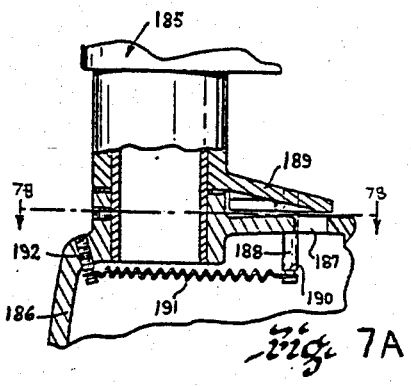
FIG. 7A is a fragmentary view partially in section of another mechanism for properly positioning the marking device, shown in FIG. 5B over a lens blank to be marked.
Figure 7B:
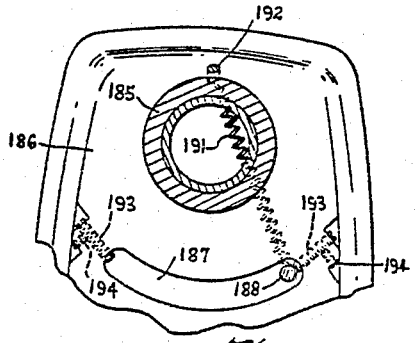
FIG. 7B is a sectional view taken on line 7B—7B of FIG. 7A.

FIGS. 7A and 7B illustrate an alternative means for adjustably locating a rotatable head 185 in either a position for aligning a lens blank to be blocked or for the blocking of the blank in a manner illustrated and described previously for casting A.

The device illustrated in FIGS. 7A and 7B include a base 186, generally similar to base 24, and has a radial slot or opening 187 provided in its upper surface which is adapted to receive a locating pin 188 press fitted within an outwardly extending boss 189 integrally formed upon the rotatable head 185.

The lower end of the pin 188 is provided with an annular groove 190 in which is fitted one end of a tension spring 191 and the opposed end of the spring 191 is attached centrally at the rear of the base 186 by a threaded screw 192. Adjustable stop pins 193 are threadedly positioned within the base 186 so as to have their forward ends extending into the ends of the radial opening 187.

Rotation of the head 185 in a clockwise direction, as viewed in FIG. 7Z causes the attached locating pin 188 to move across the slot 187, at which time the tension in spring 191 continues to increase until it reaches a point of maximum tension halfway across the slot 187. Continued rotation causes the tension to decrease somewhat until the locating pin 188 contacted the left-hand stop pin 193. The overcenter condition of the spring then causes the spring to retain the locating pin against the stop pin 193. Counterclockwise rotation of the head 185 then returns the locating pin 188 to the position shown in FIG. 7B wherein the spring 191 is again in an overcenter position. Stop pins 193 may be threadedly adjusted in order to accurately position the head 185 for lens blank alignment or blocking and locking screws 194 are provided to retain the stop pins 193 in their proper positions.

Figure 8A:
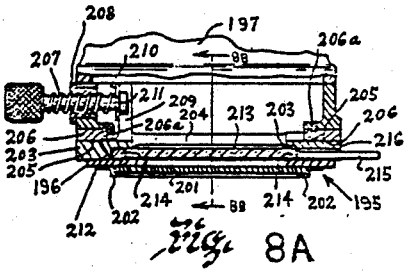
FIG. 8A is a fragmentary sectional view of another form of the target supporting mechanism.
Figure 8B:
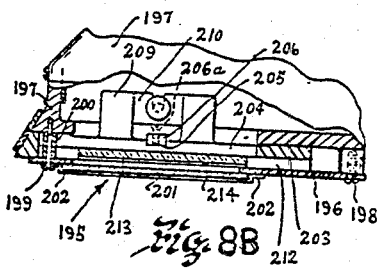
FIG. 8B is a fragmentary sectional view taken on line 8B—8B of FIG. 8A.

FIGS. 8A and 8B illustrate an alternative target supporting mechanism 195 formed by a supporting plate 196 attached by means of screws 198 and 199 to a head 197 which is generally similar to heads 22, 146 and 185, described previously. Screw 199 extends through a spacer member 200 positioned between the head 197 and the plate 196. A circular stationary target 201, similar to target 84, is mounted upon the forward underside of the plate 196 by supporting brackets 202 and a slide 203, having a circular opening 204, is slidably fitted between the upper surface of the plate 196 and the undersurface of the head 197. The slide 203 is further provided with a guideway 205 adapted to receive a pair of spaced keys 206 secured to the head 197 by means of screws 206*a*. An adjusting screw 207 which threadedly engages a bushing 208, press fitted to the head 197, extends inwardly and is attached to an upstanding boss 209, integrally formed upon the slide 203, by a slotted plate 210 which is suitably attached to the boss 209. The slotted plate 210 is fitted into an annular groove 211 formed on the inner end of the screw 207. Rotation of the screw 207 in on direction will cause the screw to be fed inwardly through the threaded bushing 208, thereby forcing slide 203 to move across the upper surface of plate 196 while being accurately guided by the keys 206 and guideways 205. Rotation of screw 207 in the in the other direction, however, will cause slide 203 to be similarly moved in the opposite direction.

A channel 212, extending in a direction 90 degrees to the above-mentioned direction of movement of slide 203, is provided upon the underside of slide 203 and is adapted to receive an adjustable target 213 similar to target 85 described above.

Target 213 which is formed of a suitable transparent plastic, glass or the like, is, in turn, positioned within a pair of L-shaped metal slide members 214 which are adpted to contact the sides of channel 212 and the upper surface of plate 196. One of the L-shaped members has attached an outwardly extending handle 215 which extends through a slot 216 provide in the slide 203.

Movement of the handle in a forwardly or rearwardly direction causes the target to be moved over the plate 196 and guided by the channel 212 while rotation of the screw 207 causes the target 213 to be carried by the slide 203 in a direction 90 degrees away.

The operation of the target supporting mechanism 195 is similar to that of target supporting mechanism 83, wherein screw 207 functions similar to screw 105 and handle 215 likewise functions similar to handle 100.

Figure 9:
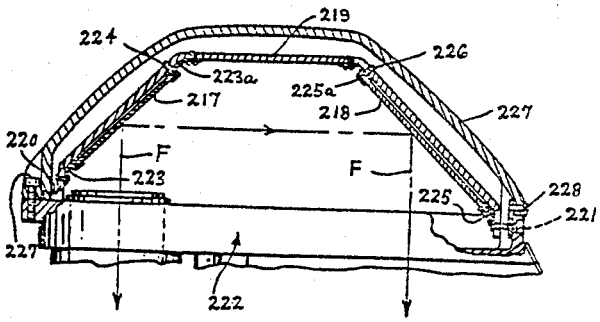
FIG. 9 is a fragmentary side sectional view of a modified light deflecting form of the device of FIGS. 1A through 1C.

FIG. 9 illustrates an alternative method of supporting a pair of reflective mirrors 217 and 218 which function generally similar to mirrors 114 and 115 respectively. The arrangement shown in FIG. 9 includes a supporting bracket 219 secured by screws 220 and 221 to a head 222 which is generally similar to heads 22, 146, 185 and 197.

Mirror 217 is positioned upon one of the inner angled surfaces of bracket 219 by yieldable clips 223 and **223*a*. Bracket 219 is further provided with an adjusting screw 224 which is adapted to engage the inner surface of clip 223*a* near the upper edge of mirror 217 and rotation of the screw 224 in one direction causes the screw to advance toward the clip 223*a*, forcing the mirror to pivot slightly about clip 223, whereas rotation of screw 224 in the opposite direction causes the mirror to return to its initial position due to the tension in the resilient clips 223 and 223*a*. By adjusting the mirror 217** a light beam, indicated by dot dash line F, may be precisely aligned for aligning a lens blank as described above.

Mirror 218 is positioned upon the forward inner sloping surface of the bracket 219 in a manner identical to that of mirror 217 wherein the function of mounting clips 225, **225*a* and adjusting screw 226** is performed in an identical manner.

A cover 227 is then positioned over the bracket 219 and is secured to the head 222 by means of a stud 227 at the rear of said cover and a screw 228 forwardly thereof.

While various aspects of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. The method of blocking a lens blank with a prescribed optical condition comprising the steps of:

(a) manually positioning a lens blank in an instrument until the prescribed optical condition has been satisfied; and (b) affixing a block to said lens blank without moving it from its adjustment position using a plunger mechanism to bring a releasable block bearing a double-faced adhesive strip into contact with the lens blank to adhesively secure the block to the blank.

2. The method of claim 1 wherein said lens blank includes a bifocal segment;

said bifocal segment is centered on said instrument; and the adjustment is continued to decenter said bifocal segment by a prescribed amount.

3. The method of claim 1 wherein said instrument includes targets which are projected through said lens blank on a ground glass screen.

4. The method of claim 3 wherein said instrument includes a mirror to permit an operator to view the projected targets and said lens blank.

5. The method of claim 2 wherein said instrument includes support pins for said lens blank.

6. The method of claim 1 wherein said instrument is used to apply a preformed block to said lens blank.

* * * * *